US007475483B2

(12) United States Patent
Peyser et al.

(10) Patent No.: US 7,475,483 B2
(45) Date of Patent: Jan. 13, 2009

(54) SHAVING IMPLEMENT

(75) Inventors: Mark S. Peyser, Easton, CT (US); Dale W. Neely, Cheshire, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 68 days.

(21) Appl. No.: 11/786,678

(22) Filed: Apr. 11, 2007

(65) Prior Publication Data

US 2007/0245576 A1 Oct. 25, 2007

(51) Int. Cl.
*B26B 21/52* (2006.01)

(52) U.S. Cl. ..... 30/529; 30/41; 30/50; 30/527

(58) Field of Classification Search ..... 30/41, 30/50, 527, 529, 531
See application file for complete search history.

(56) References Cited

U.S. PATENT DOCUMENTS

| | | | | |
|---|---|---|---|---|
| 827,718 | A | 8/1906 | Vom Eigen | |
| 1,552,234 | A | 9/1925 | Roebuck | |
| 2,510,951 | A | 6/1950 | Bleeker et al. | |
| 4,926,553 | A * | 5/1990 | Miskin et al. | 30/49 |
| 6,675,480 | B2 * | 1/2004 | Oswald | 30/43.92 |
| 6,886,254 | B1 | 5/2005 | Pennella | |
| 7,103,976 | B2 * | 9/2006 | Pennella | 30/32 |
| 2003/0200660 | A1 | 10/2003 | Pennella | |
| 2005/0015990 | A1 * | 1/2005 | Barone et al. | 30/41 |
| 2005/0172495 | A1 | 8/2005 | Pennella | |
| 2006/0288595 | A1 | 12/2006 | Takeshita | |
| 2007/0180700 | A9 * | 8/2007 | Sandor et al. | 30/41 |

OTHER PUBLICATIONS

PCT International Search Report and Written Opinion, International Application No. PCT/US2008/059821, International Filing Date Apr. 10, 2008; Date Mailed Jul. 14, 2008.

* cited by examiner

*Primary Examiner*—Hwei-Siu C Payer
(74) *Attorney, Agent, or Firm*—Michaud - Duffy Group LLP

(57) ABSTRACT

A shaving implement is provided that includes a replacement cartridge mounted to a handle. The replacement cartridge includes a shaving aid body and a razor cartridge. The shaving aid body can be erodible and the handle is provided with a self-leveling mechanism to relatively maintain a generally coplanar relation between the top surface of the shaving aid body and the shave plane of the razor cartridge during a normal shaving operation as the shaving aid body erodes during use. The shaving implement is provided with limited pivotal motion of the replacement cartridge relative to the handle about three generally mutually perpendicular axes and combinations of the three axes. Biasing force is provided to urge the replacement cartridge to a neutral position relative to the three axes.

16 Claims, 6 Drawing Sheets

SHAVING IMPLEMENT

TECHNICAL FIELD

The present invention is related to shaving implements in general and, more particularly, to shaving implements having improved abilities to maintain contact with surfaces being shaved.

BACKGROUND

Shaving implements typically include a razor cartridge mounted to a handle. The cartridge includes a housing having at least one razor blade having a cutting edge, that is located aft of a leading portion of the housing and forward of a trailing portion of the housing. A guard is mounted to or integral with the leading portion and a cap is mounted to or integral with the trailing portion. The guard and cap each have skin-engaging surfaces that cooperate to define a theoretical shave plane tangential to each of the guard and cap skin-engaging surfaces. The at least one razor blade is disposed such that its cutting edge is adjacent the shave plane. The razor cartridge may be movably mounted to the handle to allow the razor blades an increased range of movement during a shaving operation. Shaving aid material is often applied in anticipation of, or during a shaving operation to soften the hairs, condition the skin, provide lubrication, etc.

In some shaving implements, a shaving aid body comprising a soap-type shaving aid material may be positioned to partially or entirely surround the razor cartridge, thereby enabling a user to apply shaving aid material during the shaving process. However, because soap-type shaving aid materials erode during use, most of these types of shaving implements include a self-leveling mechanism that keeps the top surface of the shaving aid body and the shave plane of the razor cartridge substantially coplanar during use in order to provide the device with a suitable service life.

In shaving implements that utilize self-leveling mechanism, the shaving aid body and the razor cartridge move relative to each other in order for the shaving aid body and the razor cartridge to remain coplanar during the shaving operation. By remaining coplanar, both the shaving aid body and the razor blades contact the skin simultaneously during normal shaving. In some embodiments, pivotal motion of the razor cartridge relative to the shaving aid body is also permitted.

In any of the above-described shaving implements, the nature of limited pivotal movement or non-pivotal movement of the razor cartridge may cause the razor blades to occasionally lose contact with the surface being shaved, particularly as the user moves the implement over a relatively sharply-defined contour in the surface (e.g., over the edge defined by the ankle or shin, or over a fold of skin in the axillary region). In these instances a less-than-optimum shave may be produced, which may result in the user having to shave one area several times. By causing the razor blades to engage and re-engage the same surface multiple times, the skin, particularly in sensitive areas, may become irritated and cause discomfort to the person being shaved.

Based on the foregoing, what is needed is a shaving implement that is capable of maintaining the razor blades and the shaving aid body in contact with the surface being shaved over difficult-to-shave contours.

SUMMARY

In one aspect, the present invention resides in a shaving implement having a handle and a replacement cartridge. The replacement cartridge includes a shaving aid body and a razor cartridge. The shaving aid body has a top surface and the razor cartridge defines a shave plane. The handle includes a self-leveling mechanism to maintain the top surface and the shave plane in generally coplanar relation as the shaving aid body that, if an erodible material, erodes during-normal use. The self-leveling mechanism permits generally linear motion of one of the razor cartridge and shaving aid body in a first direction. The other of the razor cartridge and shaving aid body can move in a generally opposite direction. A first pivoting arrangement is disposed between the handle and the shaving aid body that permits limited pivotal motion of razor cartridge and shaving aid body, together as a unit about an axis generally parallel to an elongated cutting edge of the razor cartridge. A second pivoting arrangement is disposed in the self-leveling mechanism and is attached between a platform of a carriage attached to the shaving aid body and the handle. The second pivoting arrangement permits pivotal movement of the razor cartridge and the shaving aid body, together, relative to the handle about at least one of a second axis and a third axis. The second axis extends generally parallel to the direction of self-leveling movement of at least one of the razor cartridge and the shaving aid body and generally perpendicular to the first axis. The third axis extends generally perpendicular to both the first and second axes. Biasing force can be provided to provide the replacement cartridge with a neutral position in relation to all three axes relative to the handle.

In another aspect the present invention resides a handle for a shaving implement. The handle includes a handle housing and a self-leveling mechanism disposed partially within the housing. The self-leveling mechanism includes a razor cartridge carriage and a shaving aid body carriage. The self-leveling mechanism permits generally linear motion of one of the razor cartridge carriage and shaving aid body carriage in a first direction. The other of the razor cartridge carriage and shaving aid body carriage can move in a generally opposite direction. The shaving aid body carriage includes a slider having a concave partially spherical surface and a platform having a convex partially spherical surface. The concave and convex partially spherical surfaces of the slider and platform mate to provide a ball joint, also known as a ball and socket joint, that permits pivotal movement of the shaving aid body carriage relative to the housing about an axis generally parallel to the direction of self-leveling movement of one of the razor cartridge carriage and the shaving aid body carriage.

The permitted pivotal motions of the replacement cartridge relative to its handle allows the razor blades more likely to remain in contact with the surface being shaved, as compared to shaving implements in which one or both of the razor cartridge and shaving aid body do not pivot relative to the handle or pivot about only one axis.

DETAILED DESCRIPTION

Figure 1:
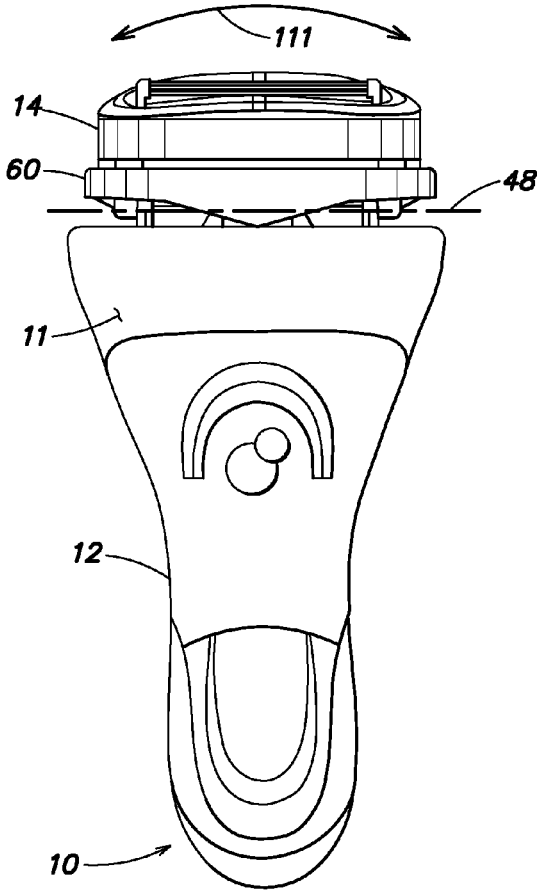
FIG. 1 is a front view of an embodiment of a shaving implement of the present invention.
Figure 2:
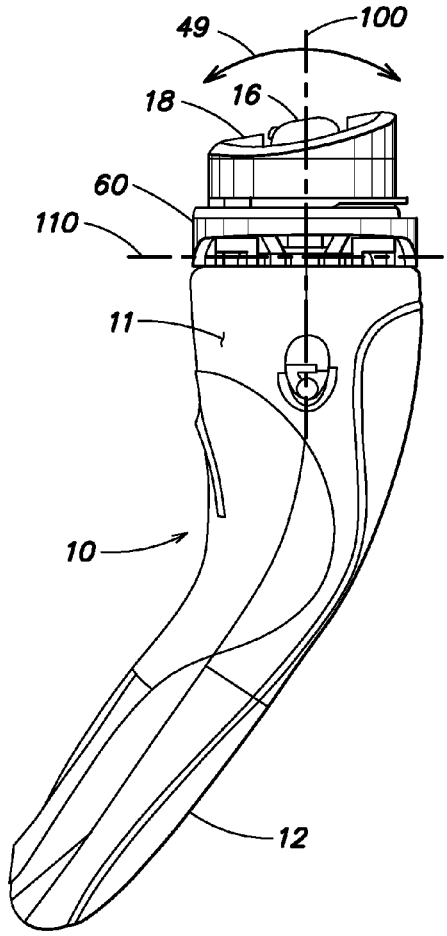
FIG. 2 is a side view of the shaving implement of FIG. 1.
Figure 3:
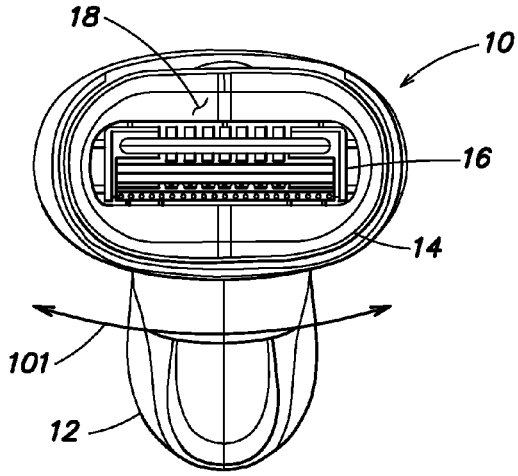
FIG. 3 is a top view of the shaving implement of FIG. 1.

Referring to the drawings and in particular FIGS. 1-3, an exemplary embodiment of a shaving implement of the present invention is shown generally at 10. The shaving implement 10 includes a handle 12, a shaving aid body 14 operably attached to the handle, and a razor cartridge 16 operably connected to the handle. The shaving aid body 14 and the razor cartridge 16 together comprise a replacement cartridge 20 and the replacement cartridge is mounted on the handle 12 such that both the shaving aid body and the razor cartridge are pivotal as a unit relative to the handle in a manner that will be described later in the present application. The handle includes a handle housing 11 having a self-leveling mechanism 60 that will also be described later in the present application that enables the shaving aid body 14 to move relative to the razor cartridge 16.

The handle 12 is of any suitable shape and size that allows it to be gripped and manipulated by the user. One exemplary type of handle is shown and described in U.S. Design Pat. No. 500,169 to Dombrowski et al., which is hereby incorporated by reference in its entirety. However, the present invention is not limited in this regard, and other handles are within the scope of the present invention. In any embodiment, the handle 12 is preferably ergonomically or similarly contoured.

Figure 4:
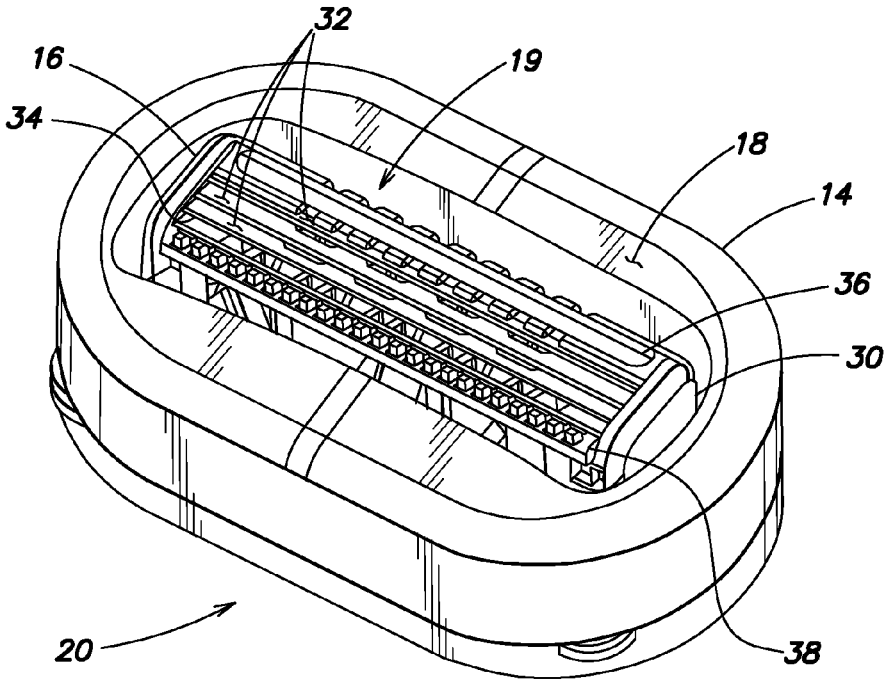
FIG. 4 is an isometric view from above of an embodiment of a replacement cartridge of the present invention.
Figure 5:
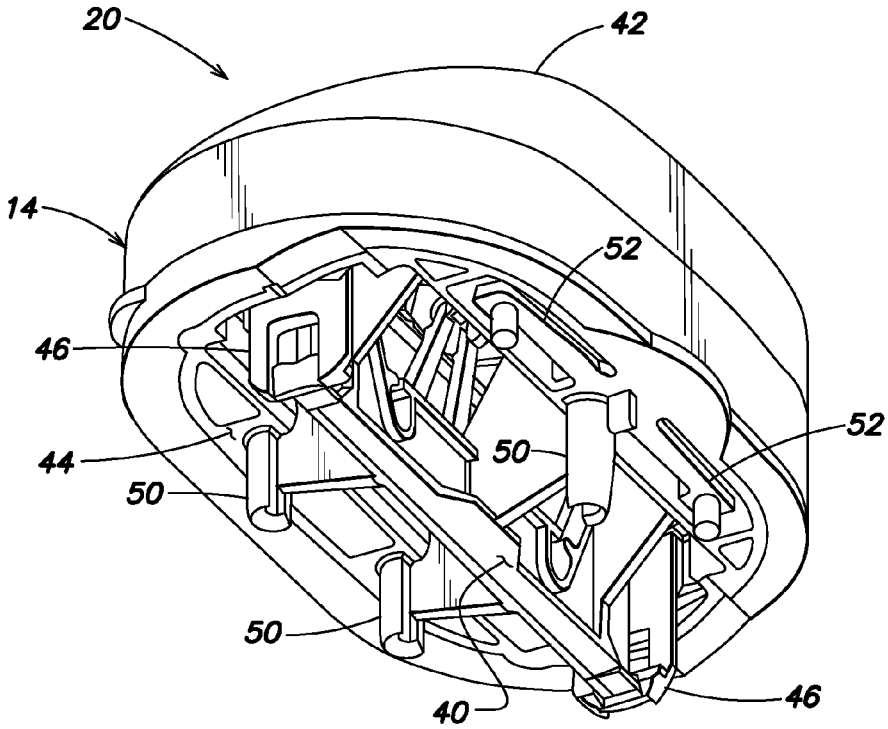
FIG. 5 is an isometric view from below of an embodiment of the replacement cartridge of FIG. 4.

Referring additionally now to FIGS. 4-5, an exemplary embodiment of a replacement cartridge of the present invention is shown generally at 20. The replacement cartridge includes a razor cartridge 16. The razor cartridge includes a cartridge housing 30 including at least one razor blade 32 having an elongated cutting edge 34 disposed therein. In the razor cartridge depicted, three razor blades are shown, but the present invention is not limited in this regard and more or less than three razor blades can be usefully employed. The cartridge housing has a cap 36 positioned aft of the razor blade(s) and a guard 38 positioned forward of the razor blade(s). The skin engaging surfaces of both the guard and cap cooperate to define a theoretical plane (not shown) known as the shave plane, tangent to both. The cutting edge(s) of the razor blade (s) are arranged adjacent to the shave plane. The razor cartridge is pivotally attached to a holder 40 which is in turn slidably coupled to a base 44 of the shaving aid body. The execution of this attachment and slidable coupling between the razor cartridge, the holder and the base are well known to one of skill in the art and are described for example in U.S. patent application Ser. No. 10/367,255 now U.S. Pat No. 7,266,895, the disclosure of which is hereby incorporated by reference in its entirety.

The shaving aid body 14 includes a body of a shaving aid material 42 attached to a base 44. One exemplary type of shaving aid body is disclosed in U.S. patent application Ser. No. 10/367,133 now U.S. Pat. No. 7,370,419, which is hereby incorporated by reference in its entirety. The shaving aid body 14 can include any suitable type of shaving aid material, such as an erodable solid body of shaving aid material that is selected to suit the application at hand. A soap-type shaving aid material is particularly well-suited for wet shaving applications in which the shaving implement 10 may be used. Other shaving aid materials (e.g., lubricating agents, drag-reducing agents, depilatory agents, cleaning agents, medicinal agents, sensory agents, skin stimulators, etc.) can be used in combination with soap-type shaving aid materials. The present invention is not limited to erodable soap-type shaving aid materials, however, and other types of material such as non-erodable foams or similar porous material from which soaps or other shaving aid materials may be exuded are within the scope of the present invention. In embodiments in which the shaving aid body 14 comprises an erodable material, the top, skin contacting surface 18 continually changes during normal use. In order to maintain a generally coplanar relationship between the top surface 18 of the shaving aid body and the shave plane, a self-leveling mechanism is provided to allow the razor cartridge 16 to move relative to the shaving aid body 14.

The shaving aid body 14 is arranged such that at least a portion of the shaving aid material is adjacent the razor cartridge 16. The shaving aid body shown particularly in FIG. 4 is a single oval having a center aperture 19 in which the razor cartridge is disposed. In alternative embodiments, the shaving aid body can comprise one or more sections adjacent the razor cartridge, e.g.: a forward portion or portions; an aft portion or portions and/or side portions.

Referring in particular to FIG. 5, the base 44 includes aperture tabs 46 or the like that enable the shaving aid body and the razor cartridge to pivot relative to the handle about a first axis 48 (represented diagramatically in FIG. 1) through a limited range of motion represented diagramatically as 49 in FIG. 2. The base includes a first axis biasing member, preferably leaf springs 52 that provide a restoring moment to return the replacement cartridge to the neutral position of its first axis pivotal motion. Exemplary executions of the provision of pivotal motion about the first axis are disclosed in U.S. patent application Ser. No. 11/485,038, the parent of the present application, the disclosure of which is hereby incorporated by reference in its entirety. Mounting pins 50 extend from the base 44 to facilitate the location of the base in the handle. The base 44 can be made of any suitable material known to those of skill in the art; however, plastics such as polypropylene and ABS have proven to have particular utility.

Figure 6:
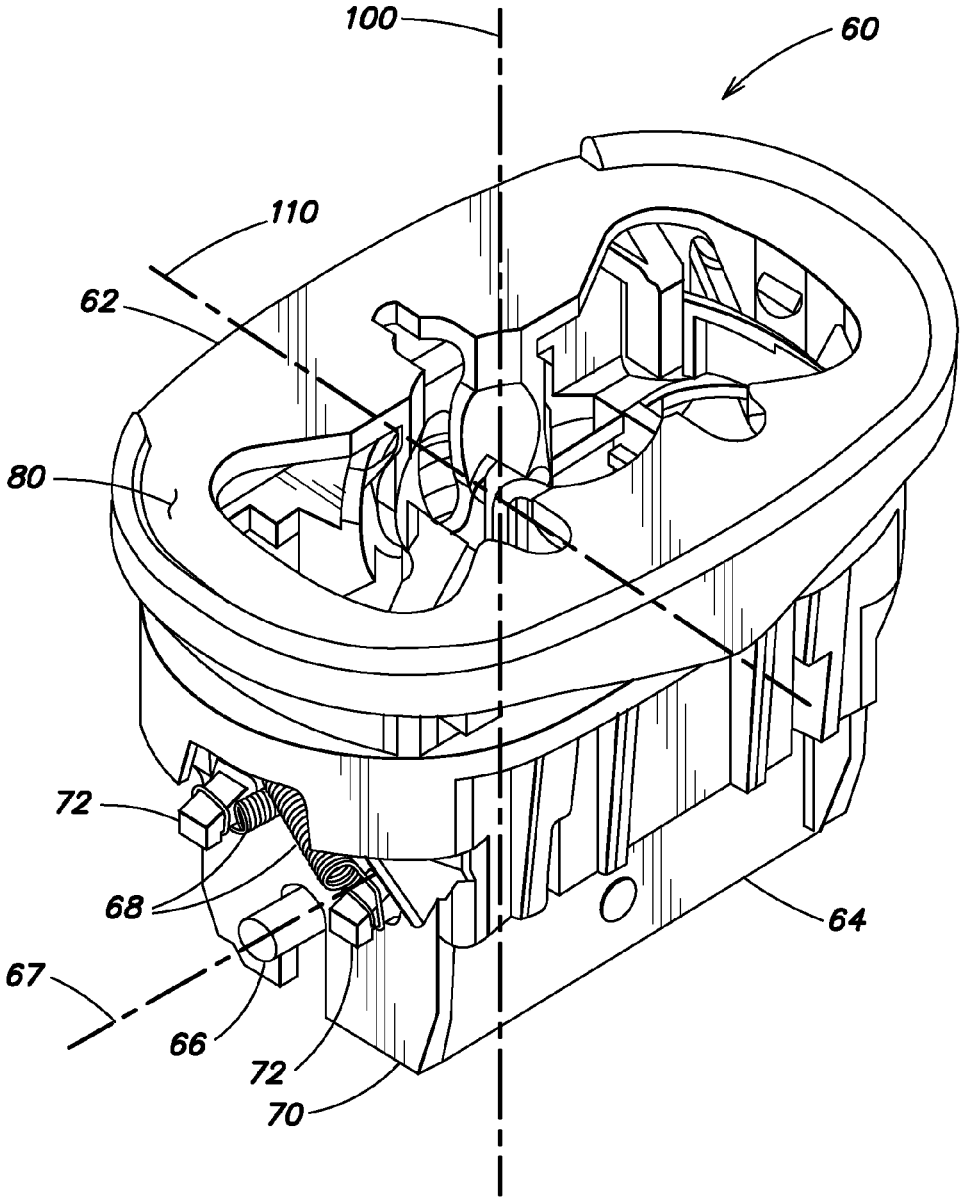
FIG. 6 is an isometric view from above of an embodiment of a self-leveling mechanism of a shaving implement of the present invention.

Referring now to FIGS. 6-12, an exemplary embodiment of a self-leveling mechanism assembly of a handle of a shaving implement is shown in FIG. 6 at 60 together with component parts thereof shown in FIGS. 7-12. The self-leveling mechanism assembly comprises a shaving aid body carriage, 62, a razor cartridge carriage, 64 and a pivot link 66 having a pivot link axis 67. The relative motions of the aforementioned parts in conjunction with the handle housing to provide a self-leveling function are well known and are disclosed for example in the aforementioned U.S. patent application Ser. No. 10/367,255 now U.S. Pat. No. 7,266,895. The shaving aid body carriage comprises a slider 70 and a platform 80. The self-leveling mechanism assembly also comprises second and third axes biasing members that include springs 68 that are preferably tension springs or elastomeric bands. The springs extend between protrusions 72 and 82 respectively of the slider and platform. The springs are preferably arranged in a cross pattern as depicted and are disposed at each end of the mechanism assembly. The springs may also be arranged side-by-side. One of skill in the art will understand that other executions of second and third axes biasing members can be provided. The springs provide a restoring moment to return the platform, and thus a replacement cartridge that may be mounted to the platform, to a neutral position relative to second and third axis pivotal motions as will be described later in the present application. The springs preferably have similar spring constants such that the restoring moment about one of the second and third axes is similar to the restoring moment about the other of the second and third axes. The springs may also be arranged such that the restoring moment about the second axis is less than or greater than the restoring moment about the third axis.

Figure 7:
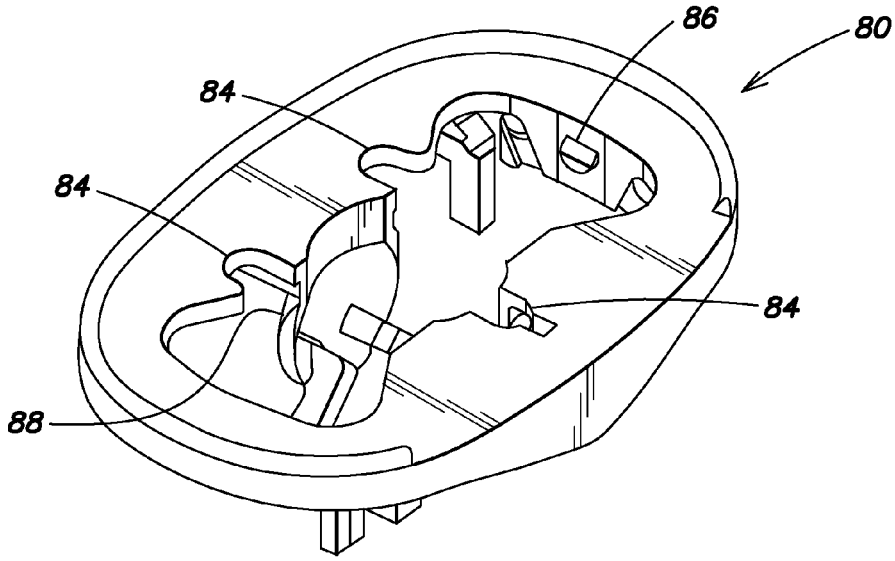
FIG. 7 is an isometric view from above of the platform of the shaving aid body carriage of the self-leveling mechanism of FIG. 6.
Figure 8:
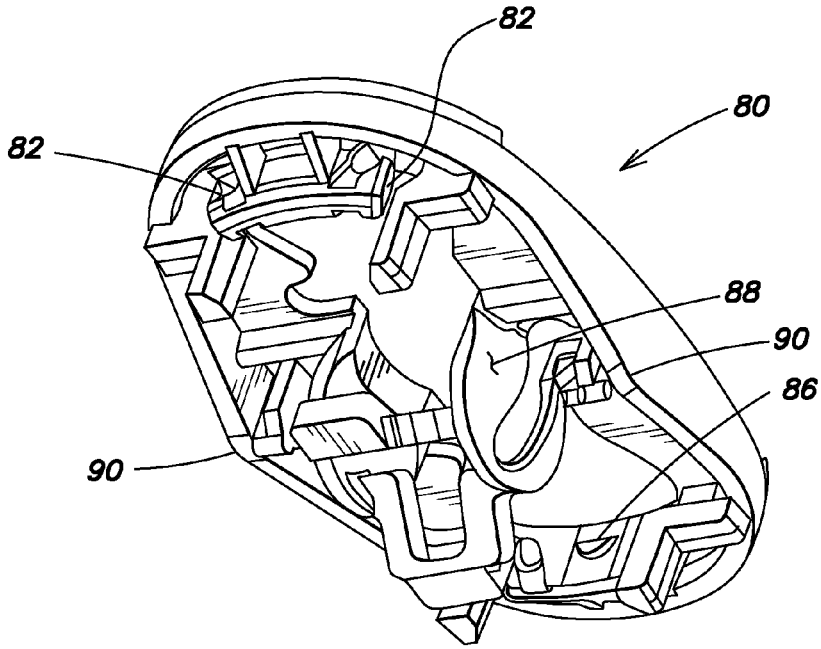
FIG. 8 is an isometric view from below of the platform of FIG. 7.

Referring additionally now to FIGS. 7-8, the platform 80 of the shaving aid body carriage is depicted. The platform includes slots 84 to accept the mounting pins 50 of the base of the replacement cartridge when a replacement cartridge is attached to the handle. The platform includes a protrusion 86 to engage the aperture of the tab 46 of the base of the replacement cartridge when a replacement cartridge is attached to the handle that together provide pivotal motion about the first axis. The platform further includes a convex partially spherical surface 88 and a fulcrum 90, the function of both will be described later in the present application.

Figure 9:
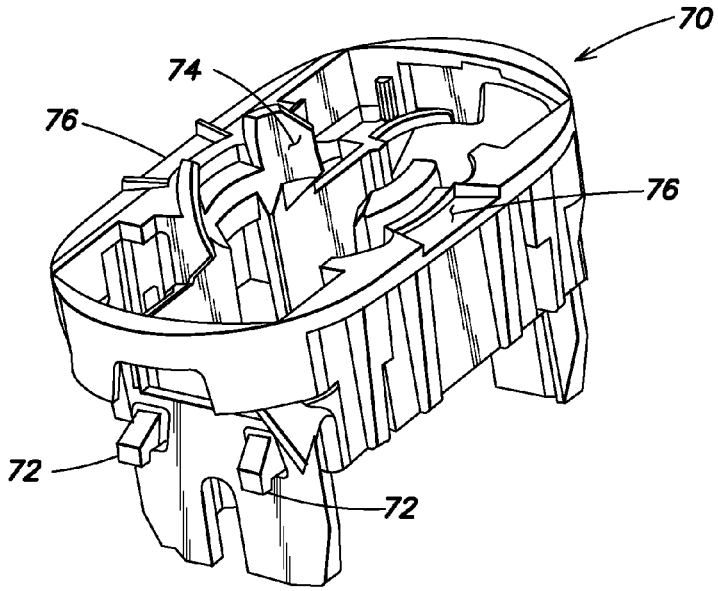
FIG. 9 is an isometric view from above of the slider of the shaving aid body carriage of the self-leveling mechanism of FIG. 6.
Figure 10:
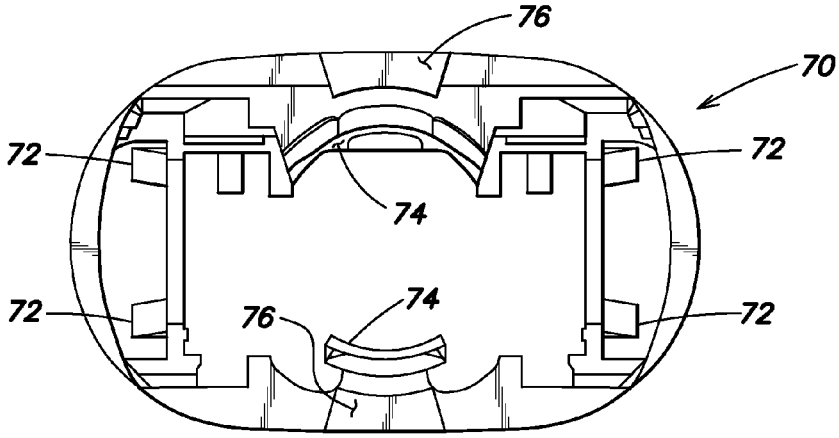
FIG. 10 is a top view of the slider of FIG. 9.
Figure 11:
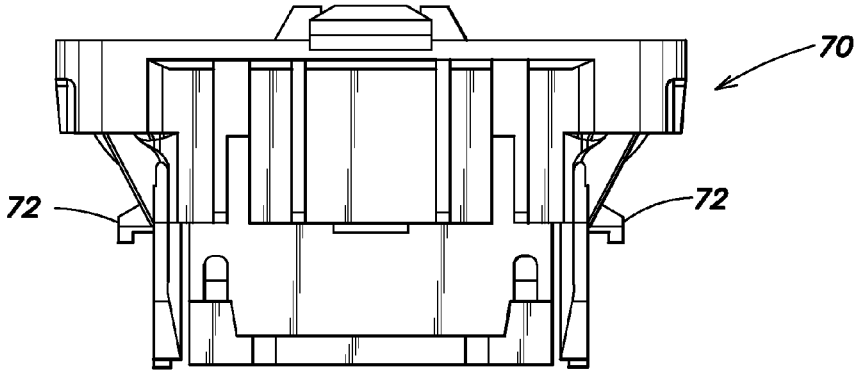
FIG. 11 is a front view of the slider of FIG. 9.

Referring additionally now to FIGS. 9-11, the slider 70 of the shaving aid body carriage is depicted. The slider includes mounting protrusions 72 for the second and third axes biasing members. The slider includes a concave partially spherical surface 74 and a pad 76. When platform is; assembled to the slider, the concave and convex partially spherical surfaces mate to form a ball joint, also known as a ball and socket joint. Fulcrum 90 abuts pad 76. Although a theoretical ball joint provides limited universal motion, i.e. limited pivotal motion about three mutually perpendicular axes, of its ball relative to its socket, abutment of the fulcrum 90 and pad 76 limit the motion of the platform relative to the slider to pivotal motion about two axes and combinations thereof. The two axes are represented diagrammatically in FIGS. 1-3 and 6 and are defined as the second axis 100 and the third axis 110. Permitted pivotal motion of the replacement cartridge about each axis through a limited range of motion is represented diagrammatically as 101 and 111 respectively in FIGS. 1 and 3.

Figure 12:
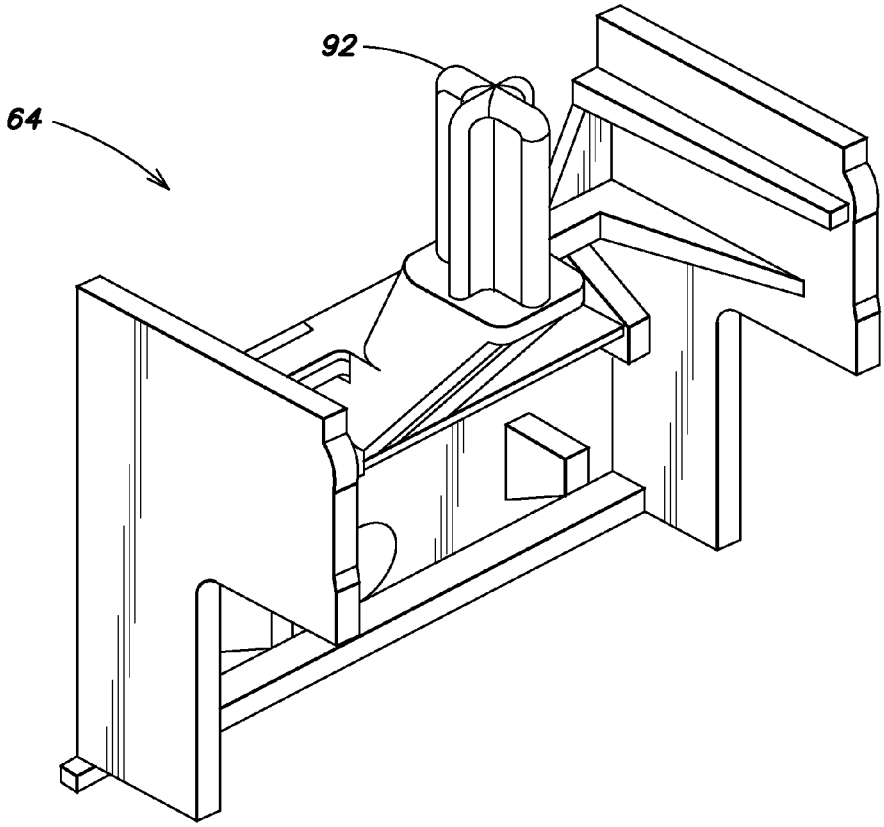
FIG. 12 is an isometric view from above of the razor cartridge carriage of the self-leveling mechanism of FIG. 6.

Referring additionally to FIG. 12, the razor cartridge carriage 64 of the self-leveling mechanism 60 is depicted. The razor cartridge carriage includes a post 92 that connects to the holder 40 of the replacement cartridge, by abutting the holder, when a replacement cartridge is attached to the handle.

As described above, when a replacement cartridge is connected to the handle described herein to provide a shaving implement, the replacement cartridge is provided with limited pivotal motion about at least two and preferably three axes, and combinations thereof, against biasing forces that provide a neutral position relative to all axes. The three axes are: a first axis generally parallel to the elongated cutting edge of the razor blade of the razor cartridge; a second axis, generally perpendicular to the first axis and generally parallel to the direction of self-leveling motion of one or both the razor cartridge and shaving aid body; and a third axis generally perpendicular to both the first and second axes. In this manner the permitted pivotal motions of the replacement cartridge relative to its handle allows the razor blades more likely to remain in contact with the surface being shaved, as compared to shaving implements in which one or both of the razor cartridge and shaving aid body do not pivot relative to the handle or pivot about only one axis.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A shaving implement, comprising:

a handle including a shaving aid body carriage platform;

a razor cartridge defining a shave plane;

a shaving aid body coupled to the handle, wherein the shaving aid body has a top surface, and wherein at least a portion of the shaving aid body is adjacent the razor cartridge;

a first pivoting means attached to the shaving aid body and the handle, the first pivoting means permitting pivotal movement of the razor cartridge and the shaving aid body, together, relative to the handle about a first axis;

self-leveling means attached to the razor cartridge and the shaving aid body, the self-leveling means permitting movement of at least one of the razor cartridge and the shaving aid body to allow the top surface of the shaving aid body to remain coplanar with the shave plane during a shaving operation; and a second pivoting means attached to the shaving aid body carriage platform and the handle, the second pivoting means permitting pivotal movement of the razor cartridge and the shaving aid body, together, relative to the handle about at least one of a second axis and a third axis, the second axis extending generally parallel to the direction of movement of at least one of the razor cartridge and the shaving aid body, the third axis extends generally perpendicular to both the first and the second axes.

2. The shaving implement of claim 1, wherein the handle further comprises a shaving aid body carriage slider and wherein the shaving aid body carriage slider and the shaving aid body carriage platform cooperate to define a ball and socket joint.

3. The shaving implement of claim 1, further comprising a biasing member that is operable to urge the shaving aid body and the razor cartridge, together, relative to the handle toward a neutral position relative to at least one of the second and the third axes.

4. The shaving implement of claim 3, wherein the biasing member is a spring.

5. The shaving implement of claim 1, wherein the shaving aid body is an erodable solid.

6. A handle for a shaving implement, comprising:

a handle housing; and self-leveling means disposed partially within the housing, the self-leveling means comprising a razor cartridge carriage and a shaving aid body carriage, the shaving aid body carriage including: a slider having a concave partially spherical surface; and a platform having a convex partially spherical surface;

wherein movement of one of the razor cartridge carriage and the shaving aid body carriage in a first direction causes the other of the razor cartridge carriage and the shaving aid body carriage to move in a second direction substantially opposite the first direction; and wherein the concave spherical surface and the convex spherical surface cooperate to permit pivotal movement of the shaving aid body carriage relative to the housing about a second axis extending generally parallel to the first direction.

7. The handle of claim 6, wherein the self-leveling means further comprises a pivot link disposed between the razor cartridge carriage and the shaving aid body carriage;

wherein movement of one of the razor cartridge carriage and the shaving aid body carriage causes the pivot link to rotate about a pivot link axis; and wherein the concave spherical surface and the convex spherical surface further cooperate to permit pivotal movement of the shaving aid body carriage relative to the housing about a third axis extending generally parallel to the pivot link axis and generally perpendicular to the second axis.

8. The handle of claim 7, further comprising a biasing member that is operable to urge the platform toward a neutral position relative to the handle toward a neutral position relative to at least one of the second and the third axes.

9. The handle of claim 8, wherein the biasing member is a spring.

10. A shaving implement, comprising:

a handle including a shaving aid body carriage platform;

a razor cartridge defining a shave plane;

a shaving aid body coupled to the handle, wherein the shaving aid body has a top surface, and wherein at least a portion of the shaving aid body is adjacent the razor cartridge;

a first pivoting means attached to the shaving aid body and the handle, the first pivoting means permitting pivotal movement of the razor cartridge and the shaving aid body, together, relative to the handle about a first axis;

self-leveling means attached to the razor cartridge and the shaving aid body, the self-leveling means permitting movement of at least one of the razor cartridge and the shaving aid body to allow the top surface of the shaving aid body to remain coplanar with the shave plane during a shaving operation; and a second pivoting means attached to the shaving aid body carriage platform and the handle, the second pivoting means permitting pivotal movement of the razor cartridge and the shaving aid body, together, relative to the handle about both of a second axis and a third axis, the second axis extending generally parallel to the direction of movement of at least one of the razor cartridge and the shaving aid body, the third axis extends generally perpendicular to both of the first and the second axes.

11. The shaving implement of claim 10, wherein the handle further comprises a shaving aid body carriage slider and wherein the shaving aid body carriage slider and the shaving aid body carriage platform cooperate to define a ball and socket joint.

12. The shaving implement of claim 10, further comprising a biasing member that is operable to urge the shaving aid body and the razor cartridge, together, relative to the handle toward a neutral position relative to both of the second and the third axes.

13. The shaving implement of claim 12, wherein the biasing member includes a spring.

14. The shaving implement of claim 12, wherein the biasing member provides a restoring moment about both the second and the third axes and the restoring moment about the second axis is greater than the restoring moment about the third axis.

15. The shaving implement of claim 12, wherein the biasing member provides a restoring moment about both the second and the third axes and the restoring moment about the second axis is substantially equal to the restoring moment about the third axis.

16. The shaving implement of claim 12, wherein the biasing member provides a restoring moment about both the second and the third axes and the restoring moment about the second axis is less than the restoring moment about the third axis.

* * * * *